US006524940B2

(12) United States Patent
Verhaverbeke et al.

(10) Patent No.: US 6,524,940 B2
(45) Date of Patent: Feb. 25, 2003

(54) METHODS AND DEVICES UTILIZING THE AMMONIUM TERMINATION OF SILICON DIOXIDE FILMS

(75) Inventors: Steven Verhaverbeke, San Francisco, CA (US); J. Kelly Truman, Morgan Hill, CA (US)

(73) Assignee: Applied Materials, Inc., Santa Clara, CA (US)

( * ) Notice: Subject to any disclaimer, the term of this patent is extended or adjusted under 35 U.S.C. 154(b) by 0 days.

(21) Appl. No.: 09/843,229

(22) Filed: Apr. 26, 2001

(65) Prior Publication Data

US 2002/0166608 A1 Nov. 14, 2002

(51) Int. Cl.[7] ..... H01L 21/44
(52) U.S. Cl. ..... 438/600; 438/585
(58) Field of Search ..... 438/585, 591, 438/592, 600, 766, 769, 770, 789, 954, 216, 281, 659

(56) References Cited

U.S. PATENT DOCUMENTS 5,660,895 A * 8/1997 Lee et al. ..... 427/579
5,846,888 A * 12/1998 Chapeck et al. ..... 438/770
5,989,988 A * 11/1999 Inuma et al. ..... 438/592
6,057,217 A * 5/2000 Uwasawa ..... 438/585
6,118,280 A * 9/2000 Matsunaga et al. ..... 324/557
6,144,062 A * 11/2000 Mine et al. ..... 257/317
6,286,526 B1 * 9/2001 Hase et al. ..... 134/100.1

* cited by examiner

*Primary Examiner*—David Nelms
*Assistant Examiner*—Phuc T. Dang
(74) *Attorney, Agent, or Firm*—Blakely, Sokoloff, Taylor & Zafman

(57) ABSTRACT

The present invention is a novel termination of silicon dioxide films for use in a single wafer cleaning tool. According to the present invention a silicon dioxide film is formed on a silicon substrate and the film is then terminated with ammonium oxide (—O—$NH_4$). In an embodiment of the present invention the film is terminated by dispensing a mixture containing ammonium oxide onto the film. The present invention also provides a method of forming a gate insulator as well as a gate insulator device.

30 Claims, 5 Drawing Sheets

METHODS AND DEVICES UTILIZING THE AMMONIUM TERMINATION OF SILICON DIOXIDE FILMS

BACKGROUND OF THE INVENTION

1. Field of the Invention

The present invention relates to the field of semiconductor processing and more specifically to a surface treatment of a silicon dioxide film on a semiconductor wafer substrate and methods and devices utilizing this surface treatment, particularly as applied in a single wafer tool.

2. Discussion of Related Art

In semiconductor manufacturing, the qualities of the gate insulator in a transistor are important in determining the capacitance of the transistor. An important quality of the gate insulator in determining the capacitance is the dielectric constant (relative permittivity.) In gate insulators it is desirable to have the highest capacitance possible. For this, the gate insulator must have a high dielectric constant. The direct relationship between the capacitance and the dielectric constant of the insulator is demonstrated by the following equation for capacitance. In this equation $C_{ox}$ is the capacitance value of two electrodes with an insulator in between:

$$C_{ox} = \frac{\varepsilon_r \varepsilon_o A}{t_{ox}}$$

In this equation $\in_r$ is the dielectric constant of the insulator, $\in_o$ is the dielectric constant of vacuum, A is the area of the capacitor, and $t_{ox}$ is the thickness of the insulator. Hence, the variables that may be manipulated to affect the capacitance are the dielectric constant of the insulator, the area of the capacitor, and the thickness of the insulator.

In the current state of the art, silicon dioxide is used as the gate insulator in transistors. Silicon dioxide has a dielectric constant of approximately 4.0. As devices are downscaled both the area (A) of the capacitor and the thickness ($t_{ox}$) of the insulator are decreased. The effect this downscaling has on the capacitance can be explained by the above equation. As the area is decreased the capacitance value will decrease. But, as the thickness is also decreased the capacitance value will increase. Therefore, as devices are downscaled, silicon dioxide may continue to be used as the gate insulator as long as its thickness is decreased along with the decrease of the capacitor's area.

The industry is now using the minimum thickness and the minimum area for gate insulators. Because these values are now constant, the only variable left that may be manipulated to increase the capacitance, while still decreasing the area (A), is the dielectric constant of the gate insulator. The capacitance of the transistor may be increased by increasing the dielectric constant of the gate insulator. Insulating materials with higher dielectric constants than silicon dioxide (higher than 4.0) must be used. Examples of such high dielectric constant materials are silicon oxynitride, silicon nitride ($Si_3N_4$), $Ta_2O_3$, and PZT ($PbZrTiO_3$).

But the use of such insulators poses a significant problem. These materials cannot be applied directly to a silicon substrate. In semiconductor processing, a silicon substrate is monocrystalline silicon that serves as the lowest layer of a wafer. A layer of silicon dioxide (native oxide) must exist between the insulating material and the silicon substrate. This layer of silicon dioxide will lower the overall dielectric constant of the gate insulator. Therefore, the dielectric constant of the silicon dioxide film must be increased in order to minimize the effect it has on lowering the overall dielectric constant of the film.

Thus, what are desired are a method and a device in which the overall dielectric constant of the gate insulator is maximized. To do this the silicon dioxide film that is sandwiched in between the silicon substrate and the high dielectric constant insulating material layer must have the highest dielectric constant possible. The present invention provides a method and device wherein the overall dielectric constant of the gate insulator is maximized.

SUMMARY OF THE INVENTION

The present invention shows a method and a device utilizing a novel surface termination of a silicon dioxide film for use in a single wafer cleaning tool. According to the present invention, the surface termination used in both the methods and the devices is ammonium oxide (—O—$NH_4$). In the present invention a silicon dioxide film is first formed on a silicon substrate, and that silicon dioxide film is then terminated with —O—$NH_4$. In one embodiment, this termination is accomplished by dispensing a mixture containing ammonium ions onto the silicon dioxide film. Further embodiments describe methods of accomplishing the termination through the use of a single wafer cleaning tool to prevent the etching of the film by the mixture containing ammonium ions. Other embodiments describe an insulator device and a wafer device.

BRIEF DESCRIPTION OF THE DRAWINGS

FIG. 1*a*-1 is an illustration of a cross-section view of the removal of the hydrogen ions from an hydroxide terminated silicon dioxide film by a solution containing ammonium ions.

FIG. 1*a*-2 is an illustration of a cross-sectional view of the termination of a silicon dioxide film with ammonium ions.

FIG. 2 is an illustration of a cross-sectional view of a single wafer cleaning tool.

DETAILED DESCRIPTION OF THE PRESENT INVENTION

In the following description numerous specific details are set forth in order to provide a thorough understanding of the present invention. One of ordinary skill in the art will understand that these specific details are for illustrative purposes only and are not intended to limit the scope of the present invention. Additionally, in other instances, well-known processing techniques and equipment have not been set forth in particular detail in order to not unnecessarily obscure the present invention.

The present invention provides methods and devices that utilize the ammonium oxide (—O—$NH_4$) termination of a silicon dioxide film. Typically, silicon dioxide films in semiconductor processing are terminated with hydroxide (—OH). Terminating a silicon dioxide film with —O—$NH_4$ instead of terminating a silicon dioxide film with —OH will maximize the overall dielectric constant of the silicon dioxide film. This occurs because a silicon dioxide surface that is terminated with —O—$NH_4$ will have a higher dielectric constant value than when it was terminated with —OH.

Figure 1A:
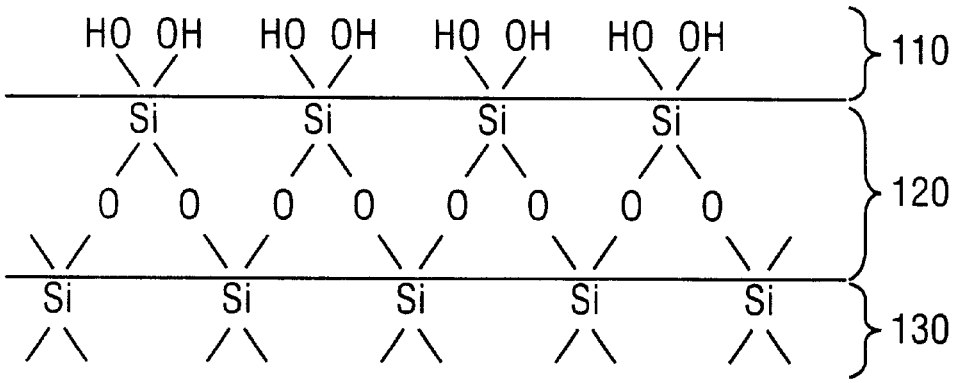
FIG. 1*a* is an illustration of a cross-sectional view of an hydroxide terminated silicon dioxide film on top of a silicon substrate.
Figure 1B:
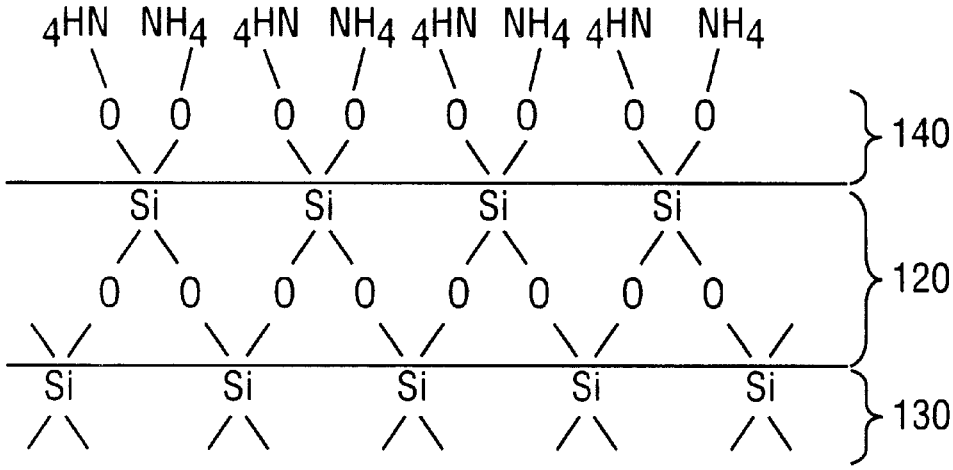
FIG. 1*b* is an illustration of a cross-sectional view of an ammonium oxide terminated silicon dioxide film on top of a silicon substrate.

In the preferred embodiment of the current invention the ammonium oxide (—O—$NH_4$) termination of a silicon dioxide film is utilized as part of a surface that is formed on a silicon substrate. A silicon substrate is comprised of monocrystalline silicon or an epitaxial layer. This surface is formed by first forming a silicon dioxide film on a silicon substrate. This is shown in FIG. 1*a*, where the silicon dioxide film 120 is formed on a silicon substrate 130 and the silicon dioxide film 120 typically has an hydroxide (—OH) termination 110.

An hydroxide terminated silicon dioxide film can be formed by rinsing a silicon dioxide surface with any solution containing hydroxide ions. Specifically, this solution can be standard clean 1 (SC1), a typical cleaning solution used in semiconductor manufacturing. The SC1 solution is a mixture of hydrogen peroxide ($H_2O_2$), ammonia ($NH_3$), and water ($H_2O$). It is optimal to form an hydroxide terminated silicon dioxide film that can be converted to an ammonium oxide terminated silicon dioxide film. This is because the percentage of the top of the silicon dioxide film that is terminated by ammonium oxide will be maximized when this specific conversion from a hydroxide terminated silicon dioxide film to an ammonium oxide terminated silicon dioxide film occurs.

The conversion of an hydroxide terminated silicon dioxide film to an ammonium oxide terminated silicon dioxide film occurs according to the following reactions and is shown in FIGS. 1*a*, 1*a*-1, 1*a*-2, and 1*b*:

$$\text{—Si—OH} \rightarrow \text{—Si—O}^{31} + \text{H}^+ \quad (1)$$

$$\text{—Si—O}^- + \text{NH}_4^+ \rightarrow \text{—Si—O—NH}_4 \quad (2)$$

Figure 1C:
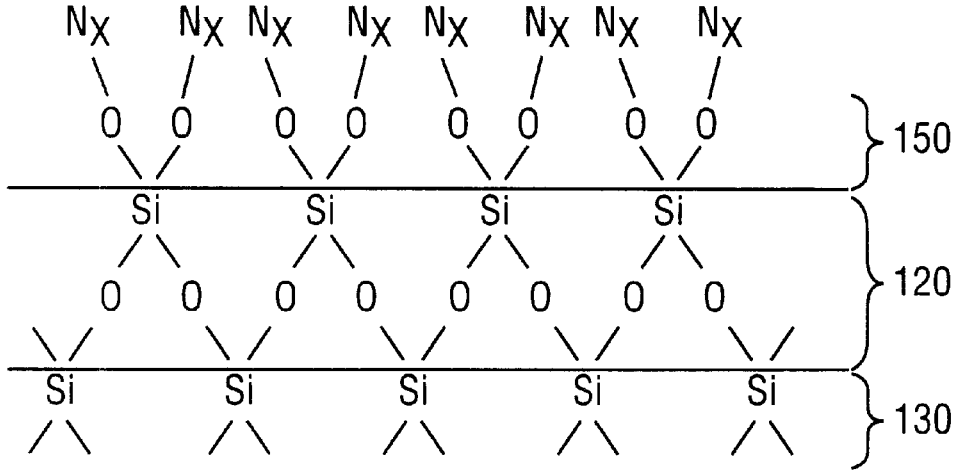
FIG. 1*c* is an illustration of a cross-sectional view of an oxynitride terminated silicon dioxide film on top of a silicon substrate.
Figures 1, 1A:
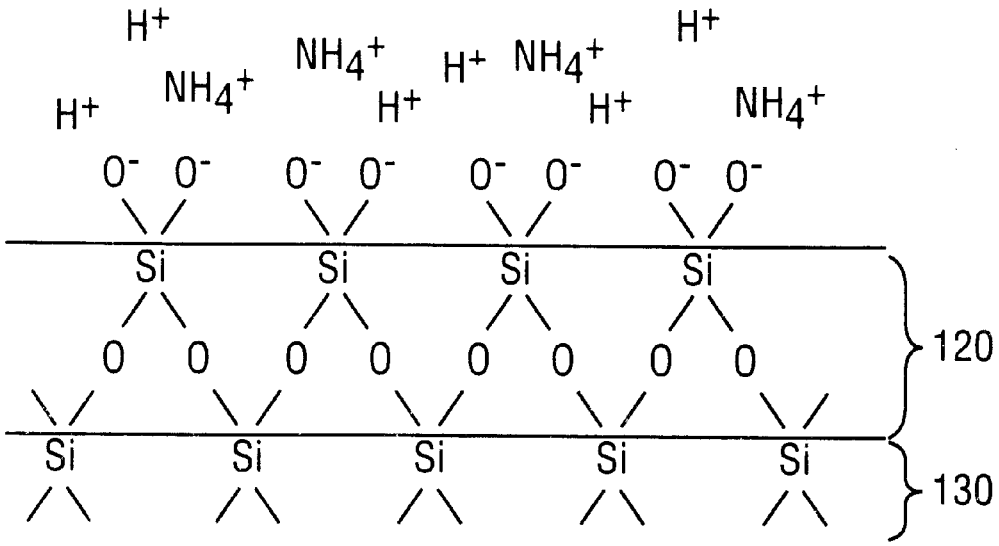
Figures 1, 1A, 2:
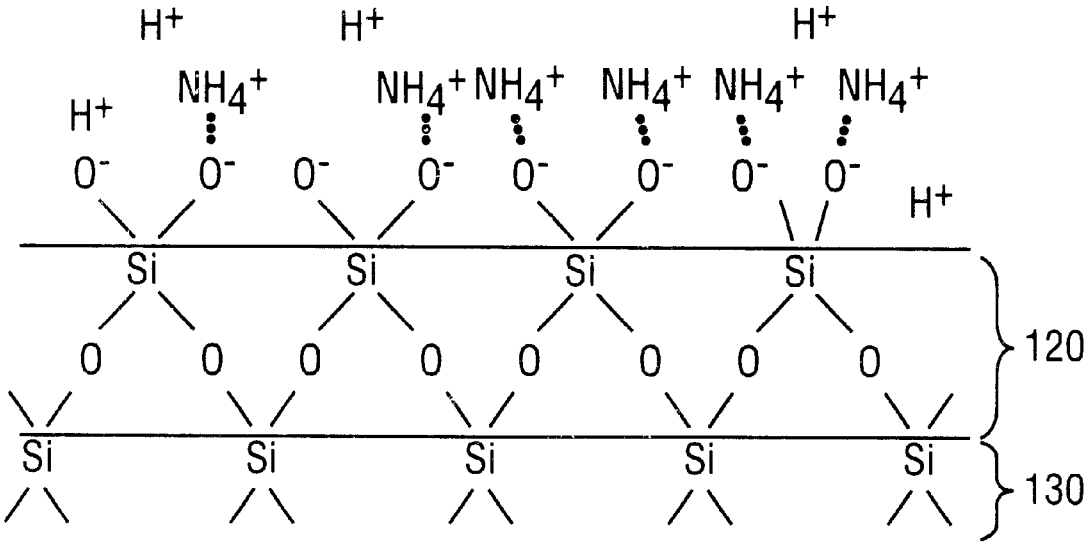
Figure 2:
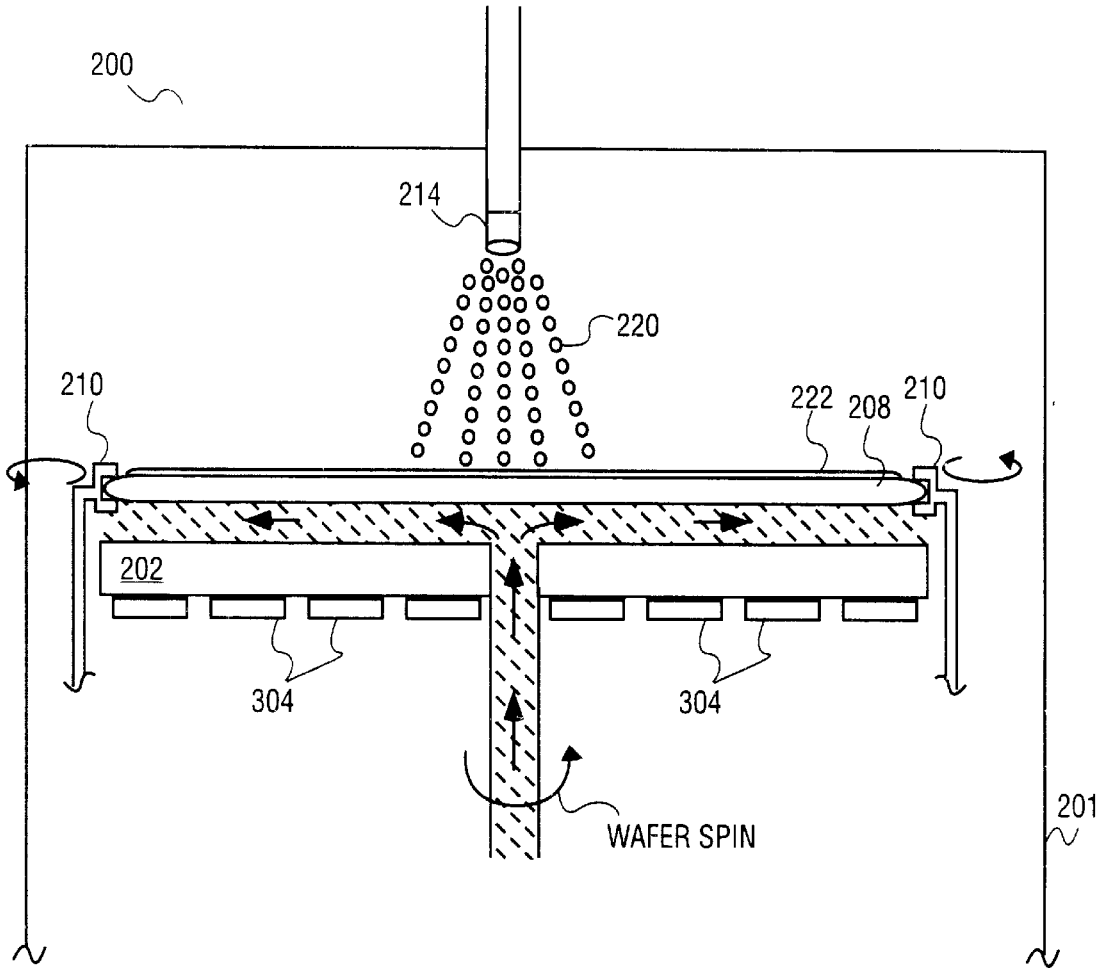

FIG. 1*a* shows the hydroxide terminated silicon dioxide film before it is rinsed with a solution containing ammonium ions. FIGS. 1*a*-1 and 1*a*-2 show the silicon dioxide surface during the rinse with a solution containing ammonium ions. FIG. 1*a*-1 depicts chemical equation (1) above, where the surface is ionized to —Si—$O^-$+$H^+$. FIG. 1*a*-2 depicts the chemical equation (2) above, where the negatively charged oxygen molecules on the surface (—Si—$O^-$) begin reacting with the ammonium ions (—$NH_4^+$) to form an ammonium oxide terminated silicon dioxide surface. This conversion is desirable because the silicon dioxide film that is terminated with —O—$NH_4$ will have a higher dielectric constant value than when it was terminated with —OH. The conversion is accomplished by dispensing a mixture containing ammonium ions onto the silicon dioxide film. The concentration of the ammonium ions in the mixture should preferably be sufficient to terminate the silicon dioxide film with at least 1% —O—$NH_4$ termination. Preferably, this mixture containing ammonium ions is comprised of water and ammonium hydroxide ($NH_4OH$). The concentration of $NH_4OH$ sufficient to terminate the silicon dioxide film with at least 1% —O—$NH_4$ is between 0.28% and 28%, and preferably between 3–28%. The ammonium ions in the mixture can also be provided by ammonium salts such as $NH_4Cl$, $NH_4Br$, $NH_4F$, or $(NH_4)_2CO_3$.

In the preferred embodiment, the termination of a silicon dioxide film with ammonium oxide (—O—$NH_4$) is done in a single wafer cleaning tool such as the apparatus 200 as shown in FIG. 2. First a wafer 208 with a top silicon dioxide film is placed in a single wafer cleaning tool. Second, a mixture 220 containing ammonium ions is dispensed onto the silicon dioxide film while it is still in the single wafer cleaning tool. The use of the single wafer cleaning tool is ideal for preventing the etching of the silicon dioxide film by the ammonium hydroxide in the mixture. It is ideal because it provides a method of quickly removing the mixture from the surface of the silicon dioxide film and thereby preventing the etching of the film. The details of the use of a single wafer cleaning tool are as follow.

In this method, the wafer 208 is clamped by a plurality of clamps 210 face up to a wafer support 212 that can rotate wafer 208 horizontally about its central axis. The wafer support can rotate or spin the wafer 208 about its central axis at a rate between 0–6000 rpm. In apparatus 200 only wafer support 212 and wafer 208 are rotated during use whereas plate 202 remains in a fixed position. This single wafer cleaning tool can also utilize acoustic or sonic waves. Plate 202 has a plurality of acoustic or sonic transducers 304 located thereon. The transducers 304 preferably generate sonic waves in the frequency range between 400 kHz and 8 MHz.

Additionally, in apparatus 200, wafer 208 is placed face up wherein the side of the wafer with patterns or features, such as transistors, faces towards a nozzle 214 for spraying solutions thereon. Apparatus 200 can include a sealable chamber 201 in which nozzle 214 and wafer 208 are located as shown in FIG. 2. The mixture containing ammonium ions is fed through nozzle 214 to generate a spray 220 of droplets that form a liquid coating 222 on the top surface of wafer 208 while wafer 208 is spinning horizontally. The liquid coating 222 can be as thin as 100 microns. Alternatively a solid flow dispense may be used instead of a spray.

Between the step where the ammonium ion mixture is dispensed and the step where the ammonium ion mixture is removed, the top of the silicon dioxide film must not be treated with any other solution. Treating the film with other solutions, in particular aqueous solutions, would affect the ammonium oxide termination by chemically converting it to another termination compound. For example, an aqueous rinse would change the —O—$NH_4$ termination back into a —OH termination.

The ammonium ion mixture 222 should be removed within a time sufficient to prevent the etching of the ammonium oxide (—O—$NH_4$) terminated silicon dioxide film by the ammonium hydroxide in the mixture. Specifically, the mixture should be removed between 1–60 seconds after dispensing the solution. To remove the mixture within this time the wafer 208 is rotated horizontally at a rate between 100–6000 rpms.

Additionally, the etching of the film may be prevented by using an ammonium hydroxide mixture with a temperature between 5–30° C. In the preferred embodiment the temperature of the mixture would be room temperature. It is to be appreciated that although the method of the present invention is ideally carried out in an apparatus 200 as shown in FIG. 2 the method of the present invention can utilize other apparatuses that are used for cleaning and rinsing a wafer.

After the termination of the silicon dioxide film with ammonium oxide, the surface could be placed in a furnace and heated to a temperature of at least 100° C. This would convert the ammonium oxide terminated surface to an oxynitride (—O—$N_x$) terminated surface as shown in FIG. 1*c*. An oxynitride terminated silicon dioxide film has an even higher dielectric constant than an ammonium oxide (—O—

$NH_4$) terminated silicon dioxide film. The oxynitride terminated surface will therefore serve to maximize the overall dielectric constant of the insulator. This annealing operation could be part of the high dielectric insulator deposition process.

Next, a high dielectric insulator is formed on top of the oxynitride terminated silicon dioxide film. In the present invention, a high dielectric insulator is defined as an insulator with a dielectric constant higher than that of silicon dioxide (higher than 4.0.) In the current invention, the preferred high dielectric constant insulator is silicon nitride ($Si_3N_4$) that has a dielectric constant of approximately 8. This high dielectric insulator is preferred because it is the easiest to work with in semiconductor manufacturing. Silicon nitride can be applied to the surface while it is still in the furnace. It may be deposited on the surface by Low Pressure Chemical Vapor Deposition (LPCVD). Other high dielectric insulators that may be used include $Ta_2O_5$ with a dielectric constant of approximately 20 and PZT ($PbZrTiO_4$) with a dielectric constant of approximately 100 could also be used.

Figure 3:
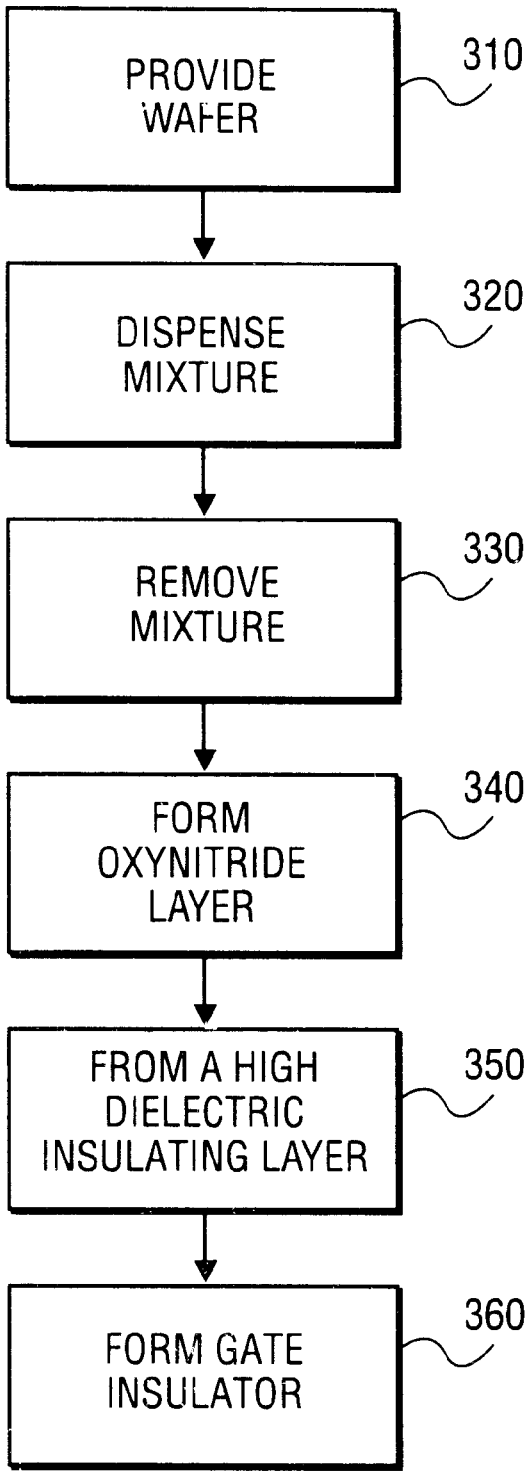
FIG. 3 is a flow-chart of the method of forming an insulator for use in either a transistor or capacitor.

The present invention also presents a method of forming a semiconductor gate insulator or capacitor insulator, as shown in the flowchart in FIG. 3. In this method, the first step 310 is to provide a wafer with an hydroxide terminated silicon dioxide film using the process described above. In the second step 320 the hydroxide terminated silicon dioxide film is converted to an ammonium oxide terminated silicon dioxide film by dispensing a mixture containing ammonium ions onto the hydroxide terminated silicon dioxide film.

In the third step 330, after the hydroxide terminated silicon dioxide film becomes an ammonium oxide (—O—$NH_4$) terminated film, the mixture containing ammonium ions is removed from the top of the wafer. This removal step must be completed in a time sufficient to prevent the etching of the film by the mixture containing ammonium ions. Note that, in between step two where the mixture containing ammonium ions is dispensed on the film and step three where the mixture containing ammonium ions is removed from the film, there must not be any other solution applied to the film. The application of any other solution to the film would alter the surface chemistry of the film and prevent the optimal conversion of the hydroxide terminated silicon dioxide film to an ammonium oxide terminated silicon dioxide film.

In the fourth step 340 a silicon oxynitride film is formed on the silicon dioxide film. This is done by placing the wafer in a furnace where it is heated to at least 100° C., as described above. In the fifth step 350, a high dielectric constant insulating layer with a high dielectric constant is formed on the oxynitride film. This insulating layer is formed on the oxynitride film while the wafer is still in the furnace where the oxynitride film was formed. The insulating layer is formed by low pressure chemical vapor deposition (LPCVD). In the final step 360, a gate electrode is formed on top of the insulating layer. The gate electrode is typically made of polycrystalline silicon, metal, or a combination of polycrystalline silicon and metal.

Figure 4:
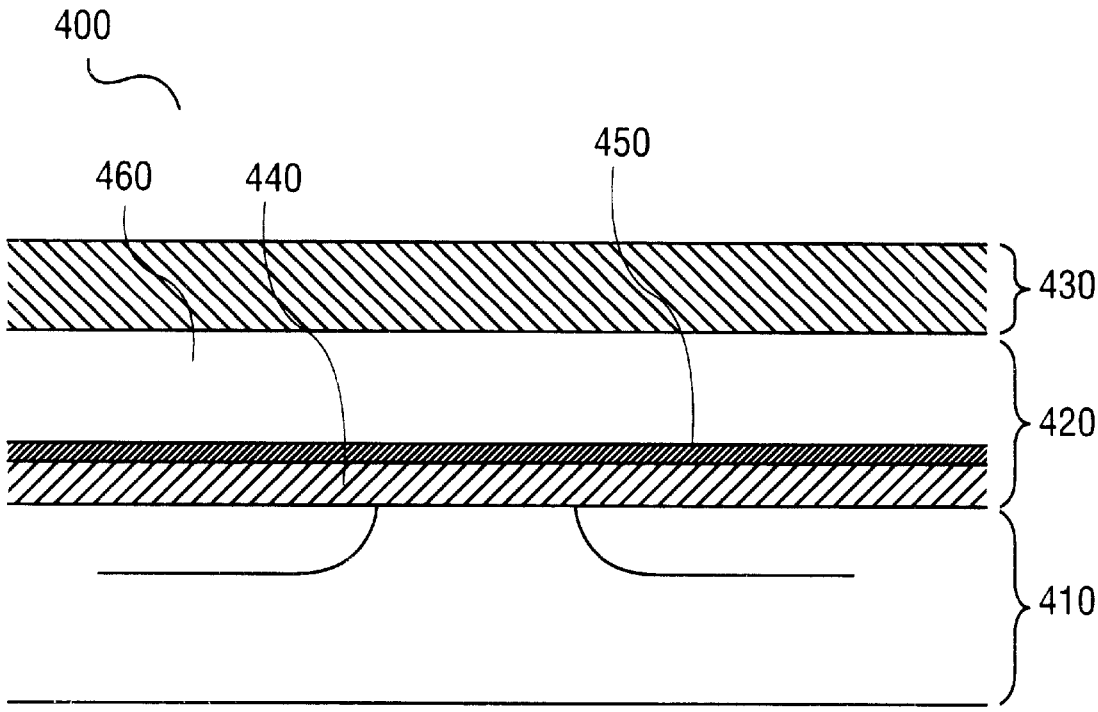
FIG. 4 is a cross-sectional view of an insulator used in either a transistor or a capacitor.

This method just described will produce a gate or capacitor insulator 420 for use in a transistor or capacitor device 400, as shown in FIG. 4. The transistor is comprised of the silicon substrate 410, the insulator 420, and the electrode 430. The capacitor is comprised of a conductive material 410, the insulator 420, and a conductive material 430. The insulator 420 is comprised of a silicon dioxide film 440 of at least one monolayer thickness. In the present invention a "monolayer" of silicon dioxide 120 (FIG. 1) is defined as a single lattice of silicon and oxygen atoms. As described earlier, an oxynitride layer 450 of at least a monolayer thickness, will be formed on top of the silicon dioxide film 440. In the present invention a "monolayer" of oxynitride 150 (FIG. 1*c*) is defined as a single lattice of oxygen and nitrogen atoms. On top of the oxynitride monolayer 450 a high dielectric constant insulator 460 would be formed as described earlier. The current invention also presents a wafer comprising a silicon substrate, a silicon dioxide film of at least a monolayer thickness, and an —O—$NH_4$ terminated silicon dioxide film. This wafer can be used to fabricate an insulator in either a transistor or a capacitor.

It is to be appreciated that the disclosed specific embodiments of the present invention are only illustrative of the present invention and one of ordinary skill in the art will appreciate the ability to substitute features or to eliminate disclosed features. As such, the scope of the applicant's methodologies are to be measured by the appended claims that follow.

Thus, methods and devices wherein the overall dielectric constant of the gate insulator is maximized have been described.

We claim:

1. A method of forming a surface on a silicon substrate comprising:

forming a silicon dioxide film on said silicon substrate;

terminating said silicon dioxide film with —O—$NH_4$ groups to form a —O—$NH_4$ terminated silicon dioxide film; and, forming a gate electrode above said —O—$NH_4$ terminated silicon dioxide film.

2. The method of claim 1 wherein said terminating of said silicon dioxide film with —O—$NH_4$ groups is done by exposing said silicon dioxide film to ammonium ions.

3. The method of claim 2 wherein the concentration of ammonium ions in a mixture is sufficient to terminate said silicon dioxide film with at least 1% —O—$NH_4$ termination.

4. The method of claim 3 wherein said mixture contains between 0.28–28% $NH_4OH$.

5. The method of claim 3 wherein said mixture contains between 3–28% $NH_4OH$.

6. The method of claim 2 wherein said ammonium ions are provided by a mixture of:

$NH_4OH$; and, $H_2O$.

7. The method of claim 2 wherein said ammonium ions are provided by a mixture of:

an ammonium salt; and, $H_2O$.

8. The method of claim 7 wherein said ammonium salt is selected from the group comprising: $NH_4Cl$, $NH_4Br$, $NH_4F$, $(NH_4)_2CO_3$.

9. The method of claim 1 wherein said silicon dioxide film is terminated by hydroxide groups prior to said dispensing of said mixture.

10. The method of claim 9 wherein a method of forming said silicon dioxide film terminated by hydroxide groups comprises:

providing a silicon substrate;

oxidizing the surface of said substrate; and, rinsing said surface with a solution containing hydroxide ions.

11. The method of claim 10 wherein said solution containing hydroxide ions comprises:

$H_2O_2$;

$NH_3$; and, $H_2O$.

12. A method of forming a surface on a silicon substrate comprising:

providing said silicon substrate with a silicon dioxide film; and, dispensing onto said film a mixture containing ammonium ions to form a —O—$NH_4$ terminated silicon dioxide film; and, forming a gate electrode above said —O—$NH_4$ terminated silicon dioxide film.

13. The method of claim 12 further comprising forming a high K insulator on said —O—$N_x$ terminated silicon dioxide film.

14. The method of claim 13 further comprising forming a high K insulator on said —O—$N_2$ terminated silicon dioxide film.

15. The method of claim 14 wherein said high dielectric constant insulator is $Si_3N_4$.

16. The method of claim 14 wherein said high dielectric constant insulator is $Ta_2O_5$.

17. The method of claim 14 wherein said high dielectric constant insulator is $PbZrTiO_4$.

18. A method of forming a surface on a wafer comprising:

placing a wafer with a top silicon dioxide film in a single wafer cleaning tool;

dispensing onto said silicon dioxide film in said single wafer cleaning tool a mixture comprising:
ammonium ions; and,
H2O, to form a —O—$NH_4$ terminated silicon dioxide film; and, forming a gate electrode above said —O—$NH_4$ terminated silicon dioxide film.

19. The method of claim 18 wherein said mixture is dispensed onto said film while said wafer is spinning horizontally.

20. The method of claim 18 wherein said mixture is dispensed onto said film for 1–60 seconds.

21. The method of claim 18 wherein said film is not treated with another mixture between the dispensing and removing steps.

22. The method of claim 18 wherein said mixture is removed from said surface by spinning said wafer horizontally.

23. The method of claim 18 wherein said wafer spins at a rate between 100–6000 rpm.

24. The method of claim 18 wherein said mixture is removed from said surface within a minimal amount of time after dispensing said mixture to prevent the etching of said silicon dioxide film.

25. The method of claim 24 wherein said mixture is removed from said surface between 1–60 seconds after dispensing said solution.

26. The method of claim 18 wherein said mixture is dispensed onto said film at a temperature sufficiently low to prevent the etching of said silicon dioxide film.

27. The method of claim 26 wherein said mixture has a temperature between 5–30° C.

28. A method of forming a semiconductor gate insulator comprising:

providing a wafer with an hydroxide terminated silicon dioxide film;

dispensing onto said film a mixture containing ammonium ions;

removing said mixture from said film to leave an —O—$NH_4$ terminated silicon dioxide film; and, forming a high dielectric constant insulating layer on said —O—$NH_4$ terminated silicon dioxide film.

29. A gate insulator comprising:

a silicon dioxide film of at least one monolayer thickness;

an oxynitride monolayer; and, a high dielectric insulator.

30. A wafer comprising:

a silicon substrate;

a silicon dioxide film of at least a monolayer thickness; and, an —O—$NH_4$ terminated silicon dioxide film.

* * * * *